US006398278B1

(12) United States Patent
Orr

(10) Patent No.: US 6,398,278 B1
(45) Date of Patent: Jun. 4, 2002

(54) ITEM COLLECTION DEVICE

(76) Inventor: Allie Ellis Orr, 206 Holly Dr., Dublin, GA (US) 31021

( * ) Notice: Subject to any disclaimer, the term of this patent is extended or adjusted under 35 U.S.C. 154(b) by 0 days.

(21) Appl. No.: 09/810,097

(22) Filed: Mar. 19, 2001

(51) Int. Cl.[7] ..... A01K 29/00; E01H 1/12

(52) U.S. Cl. ..... 294/1.4; 294/55; 15/104.8; 15/257.1

(58) Field of Search ..... 294/1.3, 1.4, 15, 294/19.1, 26, 55; 15/104.8, 257.1, 257.2; 172/372

(56) References Cited

U.S. PATENT DOCUMENTS

| | | | | | |
|---|---|---|---|---|---|
| 3,026,553 | A | * | 3/1962 | Whitmire | 294/1.4 |
| 3,659,891 | A | * | 5/1972 | Pettenon et al. | 294/1.4 |
| 3,879,079 | A | * | 4/1975 | Nicholas | 294/1.4 |
| 4,148,513 | A | * | 4/1979 | Gagne | 294/1.4 |
| 4,966,400 | A | * | 10/1990 | Hull et al. | |
| 5,303,536 | A | * | 4/1994 | Tolliver | |
| 5,742,968 | A | * | 4/1998 | Nicholson | |
| 5,842,336 | A | * | 12/1998 | Chiu | |
| 5,848,521 | A | * | 12/1998 | Kobayashi | |
| 5,918,920 | A | * | 7/1999 | Tamburro, Sr. | |
| 6,039,369 | A | * | 3/2000 | Stahovic | 294/1.4 |

* cited by examiner

*Primary Examiner*—Dean J. Kramer

(57) ABSTRACT

An item collection device that allows the user to leisurely walk around with almost no stooping or squatting down required to collect debris and nondebris items such as pine cones, golf balls, pecans, animal droppings, soda straws, toys, cigarette butts, pine straw and many, many other items, wherein this device can also be used as a storage device for items such as toys, golf balls, pecans, etc. The item collection device is comprised of an item mover and an item receiver. The item mover is comprised of a handle, striking member, lifting member and an adjustable attaching mechanism, wherein the adjustable attaching mechanism allows the item mover to be adjusted for either right hand or left hand use. The striking member is adjustably attached against the lower side of the handle. The lifting member back edge is attached to the striking member bottom edge in a lateral fashion and the lifting member extends outwardly from the striking member front side, terminating in a lifting member front edge. The item receiver is comprised of a container and a pulling cord. The container has an open front end through which items enter into the container. The container is enclosed except for the front end portion. A barrier, which functions to prevent already collected items from spilling out of the container during the item collecting process, is located on the bottom side inner surface of the container near the open front end. The pulling cord is attached to the container near the open front end and is used to pull the container in any direction on a horizontal surface and also upwards.

5 Claims, 5 Drawing Sheets

ITEM COLLECTION DEVICE

SUMMARY OF THE INVENTION

The two elements of this invention are the item mover and the item receiver wherein the user leisurely walks around pulling the item receiver with one hand and manipulating the item mover with the other hand, moving items into the item receiver and all the while remaining erect with no stooping or squatting down required for most items. This is accomplished by the fact that the item receiver is resting on the same surface, such as a lawn, as the item and movement of the item into the item receiver is essentially a movement of the item from one point on said surface to another point on the same surface with very little upward movement of the item required.

It is important to note that in stooping down to retrieve a pine cone, a person has to lift about half of his/her weight (say 50 to 100 pounds) when standing back up all in order to collect an item that probably weighs less than two ounces. This excessive energy waste and back and muscle strain is eliminated by this invention.

The item mover is comprised of a handle with a striking means attached to the lower portion of the handle, and a lifting means laterally attached to the bottom edge of the striking means, said lifting means extending outwardly to a lifting means front edge wherein the combination of the striking means and the lifting means is L shaped as viewed from the side. In use, the lifting means is nudged underneath an item, such as a pine cone, separating that item from its resting place. The handle is then moved by the user, forcing the item against the striking means which, in turn, propels the item into the item receiver. The lifting means also functions to keep the item in place against the striking means by not letting the item drop down which also results in a slightly upward direction of the trajectory of the propelled item. The slightly upwards trajectory is beneficial in that it allows the item to clear the barrier means located inside the item receiver and also other interferring obstacles, such as tall grass, the item may encounted on its journey into the item receiver.

The lifting means can also function as a hoe blade in a chopping action to dislodge embedded pine cones or rocks. It also can function as a rake blade to rake, for instance, a pile of pine straw into the item receiver. The handle is attached to the striking means in an offset position such that the item is a nominal distance in front and away from the user, similar to what the golf club provides the golfer. The handle is adjustably attached so that the handle can be adjusted for right hand or left hand use.

The item receiver is comprised of a containing means and a pulling means which is attached near the front end of the containing means. The containing means has an open front end through which items are moved into the containing means and come to rest on the bottom side inner surface of said containing means. The containing means is enclosed except for the front end portion. A barrier means located on the bottom side inner surface near the open front end places a barrier to prevent, to a limited degree, already collected items from falling out the open front end.

The item receiver can also be used as a storage device by placing it in an upright position with the open front end being the top. For instance, toys collected from a playroom floor could remain inside the item receiver until such time as they are used again.

This invention provides a superior means of collecting items because:

1) allows people to almost always remain erect with almost no stooping down or touching the item by hand required during the whole process of collection and disposal,
2) is light, relatively small and easy and simple to operate,
3) perform the item collection job more quickly,
4) requires a minimum of expended energy—the human body does not have to move up and down,
5) collects items in close and obscure places,
6) digs out and collects embedded items,
7) can also be used as a storage device,
8) is easily emptied,
9) is easily cleaned,
10) requires small storage area,
11) allows the user to select precisely the item the user desires to collect,
12) can collect almost any type item desired,
13) has a capacity of at least several bucketfulls which reduces the number of trips to and from the disposal area and
14) can be sold at a price that almost anyone could easily afford.

DETAILED DESCRIPTION OF THE INVENTION

Figure 1:
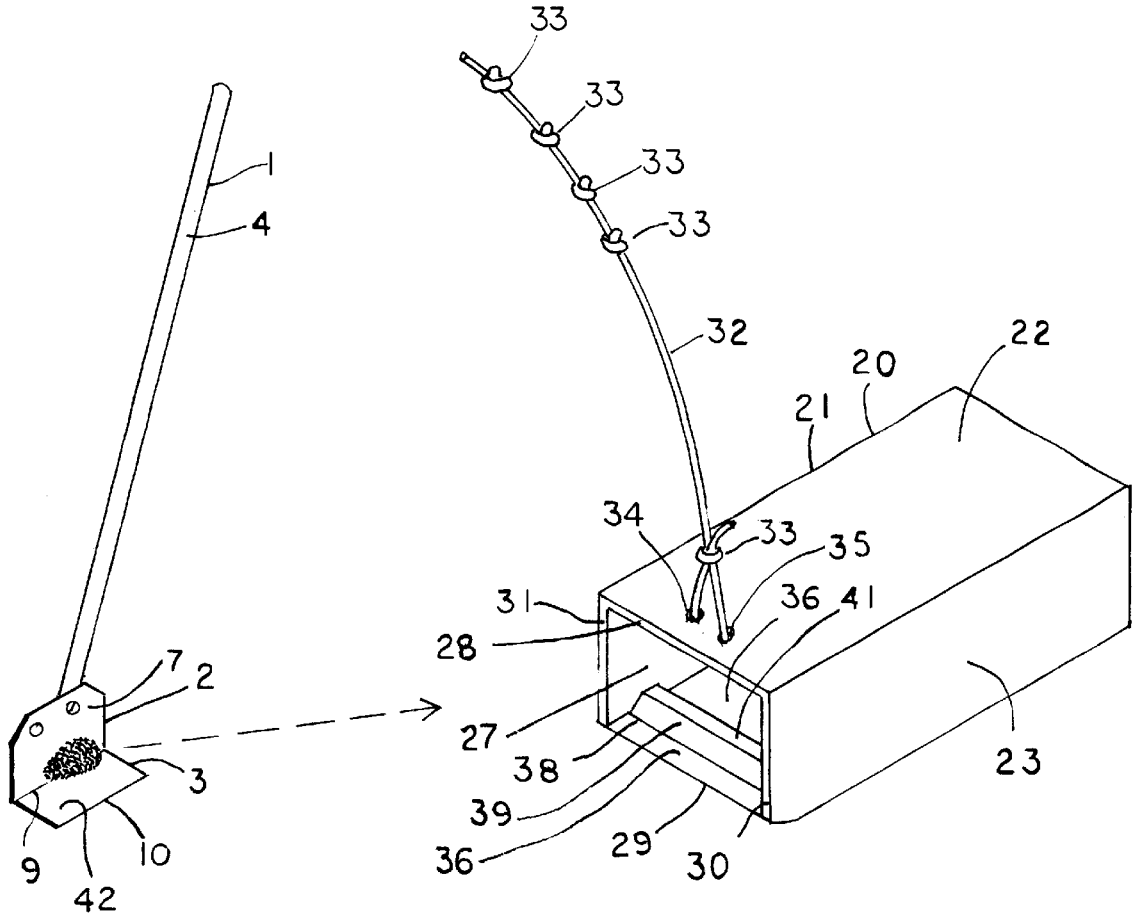
FIG. 1 is a perspective view the invention showing the item mover and the item receiver in the process of an item being moved into the item receiver by the item mover.

The instant invention is termed an item collection device and is used to manually collect both debris and nondebris items from lawns, parking lots, orchards, homes, fair grounds and other locations too numerous to mention here. This device can also be used to store items.

The two elements of this invention are the item mover (1) and the item receiver (20). In actual operation, as implied in FIG. 1, the user pulls the item receiver (20) with one hand and manipulates the handle of the item mover (1) with the other hand to move, or propel, items into the item receiver (20).

In this patent, the term "item" is used to define any object, whether debris or nondebris, that a user could collect by manipulating the handle of the item mover (1) to move said object into the item receiver (20). The term "platelike" means a configuration like metal plate, sheet metal or plastic tile having flat opposing surfaces, said surfaces being generally parallel and said surfaces being bounded by edges. The term "generally flat" means that a surface is flat except that it may have a boss(s) for strength or may have other portions that are not flat, but the portions that are flat could establish a plane. The term "generally rectangular" means rectangular but could have rounded or clipped corners or other deviations from a pure rectangular shape, but overall, the shape is recognizable as rectangular.

The striking means (2) and the lifting means (3) are treated as two separate components in this patent because they have different functions, but in reality, the two said components are rigidly joined at a junction (9) and are one physical piece.

Figure 2:
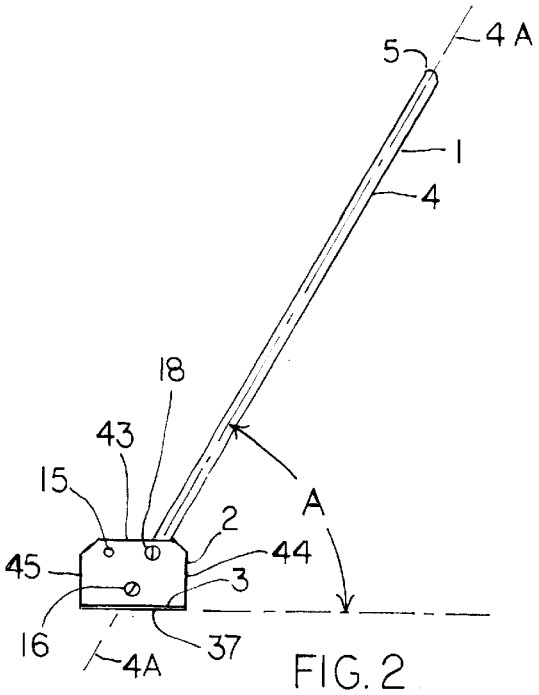
FIG. 2 is a front view of the item mover adjusted for right hand use.
Figure 3:
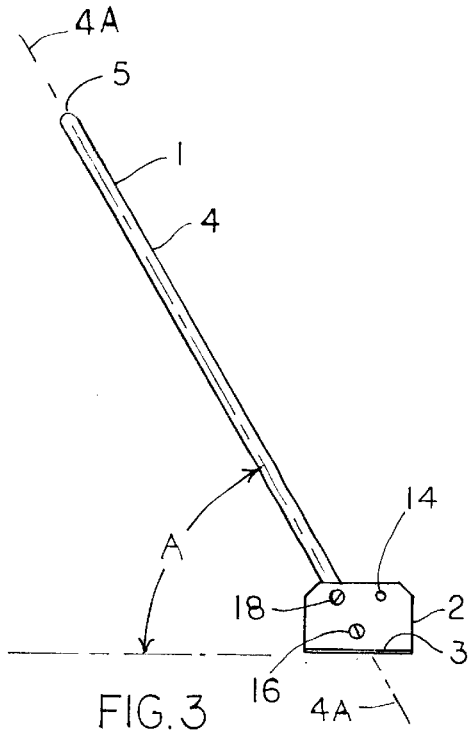
FIG. 3 is a front view of the item mover adjusted for left hand use.
Figure 11:
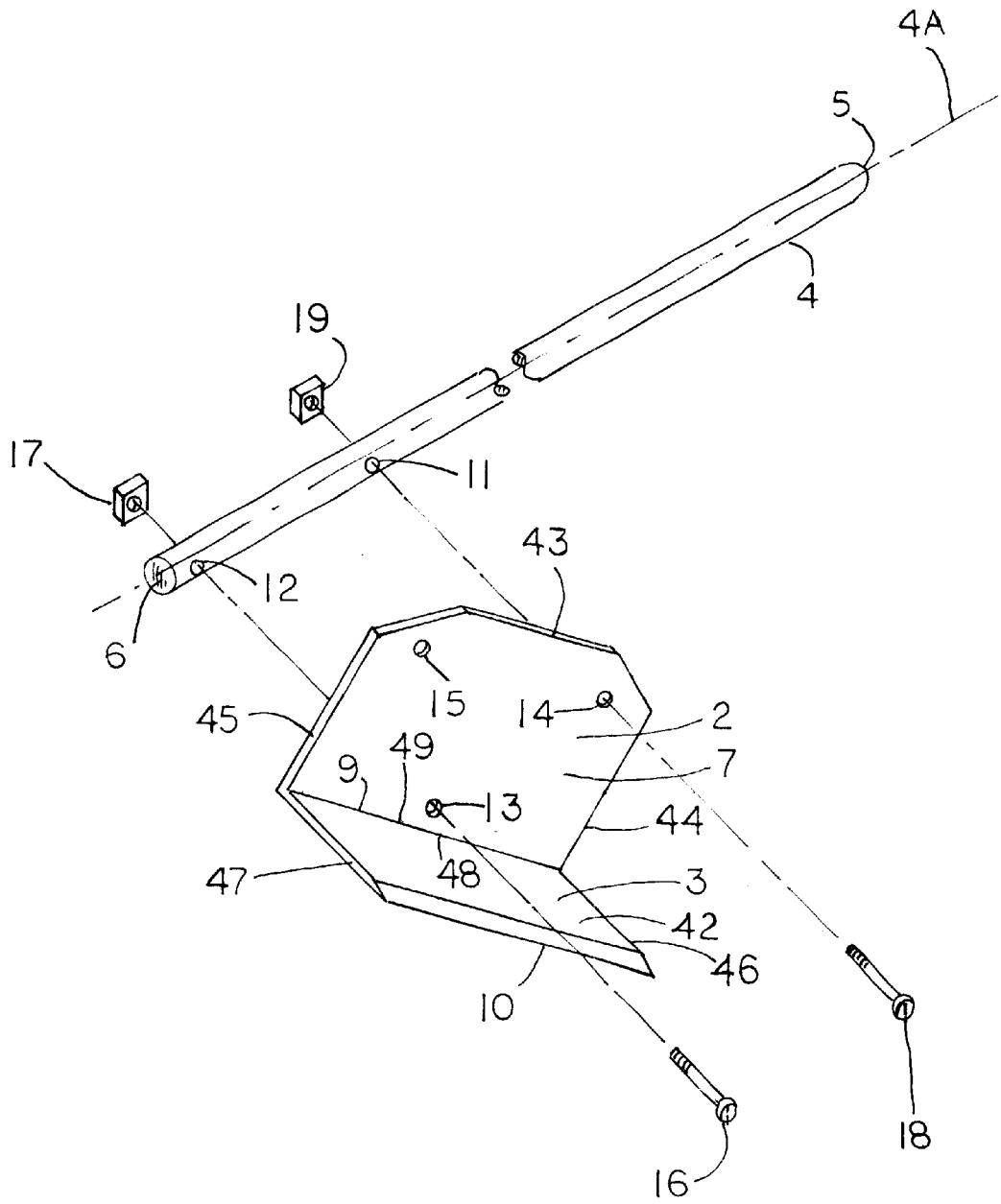
FIG. 11 is a disassembled perspective view of the item mover showing how the components fit together.

The item mover (1) is comprised of a handle (4), striking means (2), lifting means (3) and an adjustable attaching means, as shown in FIG. 11. The adjustable attaching means functions to attach the striking means (2) to the lower portion of the handle (4) in either one of two handle offset positions (FIGS. 2 and 3), wherein one position renders the item mover (1) more convenient to be used by the right hand (FIG. 2) and the other position more convenient to be used by the left hand (FIG. 3). The lower portion of the handle (4) is configured to be an integral component of the adjustable attaching means and to interface with and receive the remaining components of the adjustable attaching means. The striking means (2) is also configured to be an integral component of said adjustable attaching means and to interface with and receive the remaining components of the adjustable attaching means.

Figure 10:
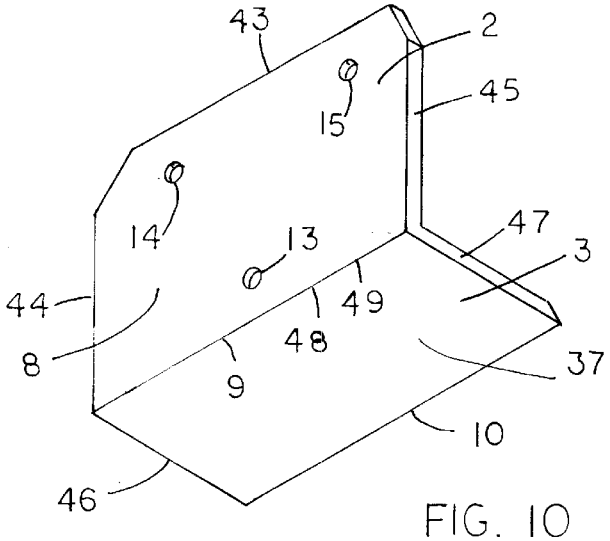
FIG. 10 is a perspective view of the striking means/lifting means assembly showing the striking means rear surface and the lifting means bottom surface.

The handle (4) is elongated and generally cylindrical in shape and has a top end (5), bottom end (6) and a longitudinal axis (4A), as shown in FIG. 11. As shown in FIGS. 2, 3 and 11, the striking means (2) is adjustably attached, by the adjustable attaching means, to the lower portion of said handle (4). The striking means (2) has a generally flat front surface (7), a rear surface (8) and a straight bottom edge (49). As shown in FIGS. 10 and 11, the lifting means (3) has a generally flat bottom surface (37), a generally flat top surface (42), a straight and generally sharp front edge (10) and a straight back edge (48).The, lifting means back edge (48) is rigidly joined to the striking means bottom edge (49) at junction (9), and the lifting means (3) extends outwardly in a lateral fashion from the striking means front surface (7) and terminates in a lifting mean front edge (10). The lifting means front edge (10) has a sharpness similar to that of the leading edge of the blade of a common hand held shovel so that the lifting means (3) can be more easily nudged underneath an item.

Figure 8:
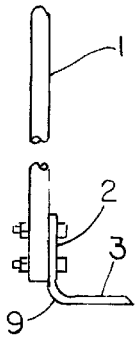
FIG. 8 is a side view of the item mover showing a rounded junction of the striking means and lifting mean.

In the preceding paragraph and in most of the drawings, the junction (9) of the striking means (2) and the lifting means (3) is a sharp L shaped intersection. However, in view of manufacturing practicality and junction strength, the string means (2) and the lifting means (3) could be formed from a single metal sheet or molded in plastic in one piece wherein the junction (9) could be rounded, as shown in FIG. 8. With this in mind, then junction (9) could either be rounded or sharp. However, if the junction is rounded, then the junction (9) would include all the material required to join the striking means bottom edge (49) to the lifting means back edge (48).

Figure 6:
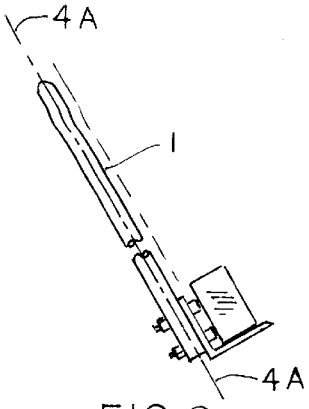
FIG. 6 is an operational side view drawing showing the item mover moving a heavy item by cradling the item between the striking means and the lifting means and also showing the plane established by the striking means front surface as being parallel to the handle longitudinal axis.

The striking means (2) is attached to the handle (4) in an orientation such that the plane established by the flat portion of striking means front surface (7) is either generally parallel to the handle longitudinal axis (4A) or includes the handle longitudinal axis (4A), regardless of which of the two handle offset positions the handle (4) is attached onto the striking means (2), as shown in FIG. 6.

Figure 5A:
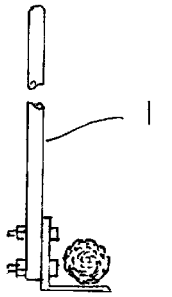
FIGS. 5A and 5B are operational side view drawings of the item mover first capturing and then propelling a pine cone.
Figure 5B:
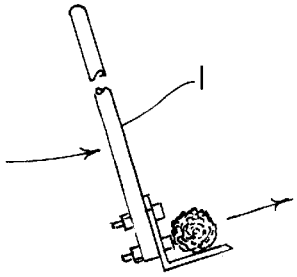
Figure 7:
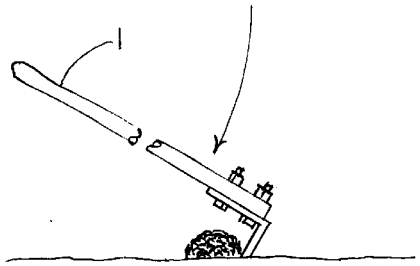
FIG. 7 is an operational side view drawing showing the item mover dislodging an embedded pine cone.

All the functions of the striking means (2) and the lifting means (3) are, of course, the result of user movement, or manipulation, of the handle (4). One function of the lifting means (3)) is to be nudged, or slipped, underneath an item, lifting and separating the item from said item's resting place and placing the item under the control of the item mover (1), ie, the item has been "captured". The striking means (2) can then apply a force, said force being in a direction generally parallel to the item bearing surface, to the "captured" item to move, or propel, the item on into the item receiver (20), said propelled item having a trajectory generally parallel to the item bearing surface, but with a slightly upwards movement. FIG. 5A shows an item with the lifting means (3) underneath said item. FIG. 5B shows the striking means (2) and the lifting means (3), in combination, propelling an item into the item receiver (20). In FIG. 5B, note the slightly upwards trajectory of the propelled item. This upwards trajectory results from the lifting means (3) holding the item against the striking means (2) by not letting the said item drop down during the swinging arc of the handle (4), said swinging arc being responsible for the slightly upwards trajectory. This slightly upwards trajectory is beneficial in that it aids the propelled item in clearing interferring obstacles, such as tall grass, in its journey into the item receiver (20) and also to clear the barrier means (38) located inside the containing means (21). Heavy items, such as a brick as shown in FIG. 6, can be lifted and moved by the item mover (1) by nudging the lifting means (3) underneath the brick and swinging the handle (4) in a short arc while rotating the handle (4) along its longitudinal axis (4A) such that the striking means (2) and the lifting means (3), in combination, form a cradle that cradles and contains the brick. This cradling procedure is also useful in moving items that are so large that the lifting means (3) cannot be nudged all the way underneath the item. As shown in FIG. 7, the lifting means (3) can function as a hoe blade in a chopping action to dislodge embedded items in a lawn, such as a pine cone or rock. The lifting means (3) can also function as a rake blade to rake, for instance, a pile of pine straw into the item receiver (20). This raking capability is also useful for retrieving items from obscure places, for instance, a pine cone underneath thick shrubbery.

The lateral angle between the striking means (2) and the lifting means (3) can vary substantially within an angle range and still render an item mover (1) that functions satisfactorily. However, it is essential that the lifting means (3) extend outwardly from the striking means (2) at some lateral angle that would allow the lifting means (3) to be nudged underneath an item and, at the same time, have the striking means (2) so positioned that the striking means (2) could apply a force in a direction generally parallel to the item bearing surface, such as a lawn, such that the item that would be moved, or propelled, into the item receiver (20).

Obviously, an item mover (1) could have a striking means (2) that had a front surface (7) that was not flat, and /or a lifting means (3) that was not flat or platelike and a user could still manage, by skillfull manipulation of the handle (4), to use the item mover (1) to lift an item from the item's resting place and to move, or propel, said item into the item receiver (20). But for better efficiency, a flat lifting means (3) is more easily nudged underneath an item than a curved lifting means where portions of the curved lifting means would stick up above a flat smooth surface and tend to push the item along rather than slip underneath the item. Also, a striking means (2) with a generally flat front surface (7), said front surface (7) also being in a plane generally parallel to, or including, the handle longitudinal axis (4A), would propel an item in a direction more in line with the direction of the of the handle movement than, say, a front surface (7) that was curved or not in the same plane.

In the preferred embodiment of this invention, as shown in FIGS. 10 and 11, the striking means (2) is generally flat and generally rectangular in shape and platelike having front surface (7), rear surface (8), a top edge(43), right edge (44), left edge (45) and a bottom edge (49), and the lifting means (3) is generally flat and generally rectangular in shape and platelike having a right edge (46), left edge (47), back edge (48), top surface (42), bottom surface (37) and a straight and generally sharp front edge (10), wherein the lengths of the striking means bottom edge (49) and the lifting means back edge (48) are equal, wherein the full length of the striking means bottom edge (49) is attached to the full length of the lifting means back edge (48), wherein the lifting means (3) back edge (48) is joined to the striking means bottom edge (49) at a junction (9), wherein said lifting means (3) extends outwardly from the striking means front surface (7) in a fashion generally perpendicular to the striking means front surface (7), wherein the lateral angle between the striking means front surface (7) and the lifting means bottom surface (37) is about 90 degrees.

Note in FIGS. 2 and 3 the handle offset angle, said angle being identified as Angle A. In FIG. 2, the handle (4) is offset to the right such that the handle top end (5) is upwards and to the right of the striking means (2) and in this position, the item mover (1) is more convenient for use by the right hand. In FIG. 3, the handle offset is to the left such that the handle top end (5) is upwards and to the left of the striking means (2) and in this position, the item mover (1) is more convenient for use by the left hand.

The handle offset angle is defined as follows:

The lifting means flat bottom surface (37) establishes a plane X. A second plane, defined as plane Y, exists that contains the handle longitudinal axis (4A) and, at the same time, said plane Y also perpendicularly intersects said plane X. The handle offset angle is the angle between the handle longitudinal axis (4A) and said plane X as measured in said plane Y.

The purpose of the handle offset is to allow the user to stand a nominal distance away from an item such that the user will not interfere in the movement path of said item in its journey into the item receiver (20). Also, the handle offset provides the user with a stance that allows a more efficient use of the arm and body muscles, somewhat like what a golf club provides for the golfer.

The exact angle of the handle offset is somewhat arbitrary and can vary considerably and still render an item mover (1) that factions satisfactorily. But in general, the smaller the angle, the further the user can stand away from the item, and vice versa. However, in the preferred embodiment of this invention, handle offset angle is about 58 degrees, which was determined by experimentation with the development model of this invention.

The arrangement of all of the components of the item mover (1) is such that a user standing on a flat, smooth, horizontal surface could easily and conveniently manipulate the handle (4) to place all of the flat portions of the lifting means bottom surface (37) in contact with said smooth, flat, horizontal surface.

Figure 9:
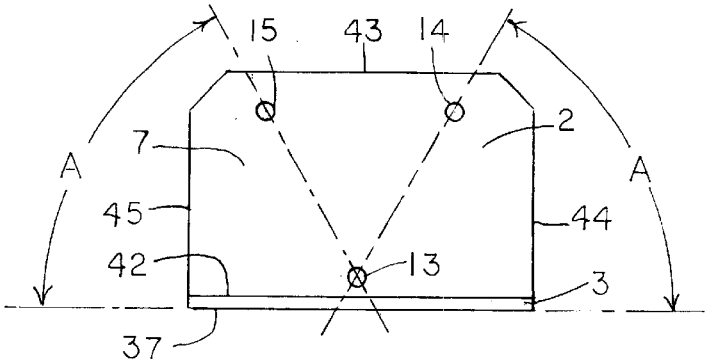
FIG. 9 is a front view of the striking means/lifting means assembly showing handle offset angle determination by hole positions in the striking means.

There are many mechanical designs that would produce an adjustable attachment means that would adjustably attach the handle (4) to the striking means (2), but in the preferred embodiment of this invention, as shown in FIG. 11, the adjustable attaching means is comprised of two holes in the lower portion of the handle (4), three holes in the striking means (2) and two bolts and two nuts. The two holes in the handle (4) are top handle hole (11) and bottom handle hole (12) wherein these two holes are parallel and the center line of each hole perpendicularly intersects the handle longitudinal axis (4A). The three holes in the striking means (2) are the bottom striking means hole (13), the top right striking means hole (14) and the top left striking means hole (15). As shown in FIG. 9, the bottom striking means hole (13) is located in the lower center portion of the striking means (2). The top right striking means hole (14) is located above and to the right of the bottom striking means hole (13). The top left striking means hole (15) is located above and to the left of the bottom striking means hole (13). All five said holes, two in the handle (4) and three in the striking means (2), are so positioned that any hole alignments mentioned hereafter are possible.

The arrangement of the three holes in the striking means (2) actually determine the handle offset angle. As shown in FIG. 9, the angle between a line drawn through the center points of the bottom striking means hole (13) and the top right striking means hole (14) and the plane established by the lifting means bottom surface (37) is the handle offset angle for a right handed item mover (1). In a similar manner, the angle between a line drawn through the center points of the bottom string means hole (13) and the top left striking means hole (15) and the plane established by the lifting means bottom surface (37) is the handle offset angle for a left handed item mover (1).

Referencing FIG. 11, when the bottom striking means hole (13) is aligned with the bottom handle hole (12) and the top right striking means hole (14) is aligned with the top handle hole (11) and Bolt A (16) and Bolt B (18) are inserted into the lower set and the upper set of aligned holes respectively and said bolts are secured by Nut A (17) and Nut B (19) respectively, the item mover (1) is adjusted for right hand use and, in the preferred embodiment of this invention, a handle offset angle of about 58 degrees is attained. If an item mover (1) was assembled as shown in FIG. 11, the item mover would be adjusted for right hand use.

Referencing FIG. 11 again, when the bottom striking means hole (13) is aligned with the bottom handle hole (12) and the top left striking means hole (15) is aligned with the top handle hole (11) and Bolt A (16) and Bolt B (18) are inserted into the lower set and the upper set of aligned holes respectively and said bolts are secured by Nut A (17) and Nut B (19) respectively, the item receiver (1) is adjusted for left hand use and, in the preferred embodiment of this invention, a handle offset angle of about 58 degrees is attained.

Figure 4:
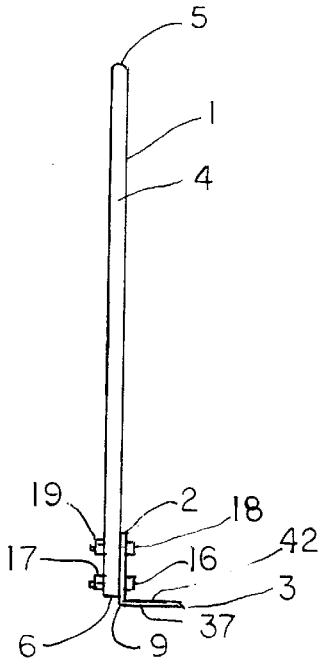
FIG. 4 is a side view of the item mover.

As shown in FIG. 4, the handle (4) is attached to the striking means (2) such that the handle bottom end (6) is sufficiently above the lifting means (3) that the bottom end (6) never strikes the surface when the item mover (1) is being used to move items into the item receiver (20).

Figure 14:
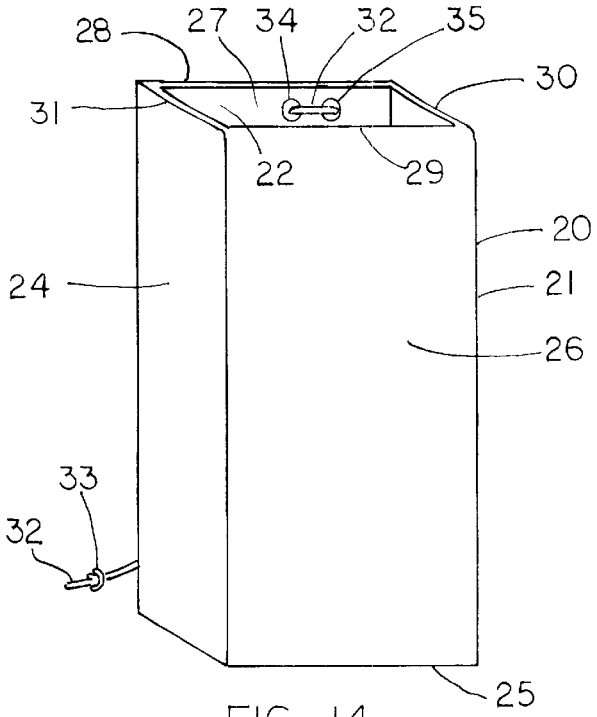
FIG. 14 is a perspective view of the item receiver in an upright position for storage purposes and also showing the pulling means attachment to the containing means.

As shown in FIGS. 1 and 14, the item receiver (20) is comprised of a containing means (21) and a pulling means (32).

The containing means (21), as shown in FIGS. 1, 12, 13 and 14, is a generally rigid structure having an open front end (27), bottom side (26), bottom side inner surface (36), back side (25), and barrier means (38). The containing means (21) is enclosed except for the front end portion and the containing means (21) has substantial vacant space in its interior. During the item collection process, the containing means (21) is oriented such that the containing means bottom side (26) rests on, or is in contact with, the item bearing surface, such as a lawn. Items that are collected come to rest inside the containing means (21) on the bottom side inner surface (36), wherein the bottom side inner surface (36) is the top surface of the bottom side (26). The open front end (27) is an open space in the containing means (21) that exposes the interior of the containing means (21) including the bottom side inner surface (36) such that an item propelled from its resting place on a surface, such as a lawn, into the containing means (21) through the open front end (27) could have a trajectory almost parallel to said surface with very little upward movement in the trajectory required.

A barrier means (38) is located on the bottom side inner surface (36) near the open front end (27) and functions to prevent a limited amount of items that are already inside the containing means (21) from filling out of the containing means (21) through the open front end (27), wherein the amount of said limited amount is generally proportional to the height of the barrier means. The barrier means (38) is so configured to leave ample open space above said barrier means (38) to allow item entry into the containing means (21). The barrier means (38) is also configured to leave ample space behind said barrier means (38) for the collected items to reside inside the containing means (21). The barrier means (38) includes a deflection means that functions to deflect entering items that happen to strike said barrier means (38) in a manner that allows most items to continue on into the containing means (21). The containing means (21) can be filled to a point where the items inside will begin to roll over the barrier means (38) and fall out the open front end (27). At this point, the item receiver (20) should be emptied.

The containing means (21) has a back side (25), as shown in FIGS. 1, 12, 13 and 14, that is so configured that the back side (25) could rest on a flat horizontal surface (FIG. 14) such that the open front end (27) would be above the back side (25), making the open front end (27) the uppermost portion of the containing means (21), all of which places the containing means (21) in an upright position, said position being useful for storing collected items or for storing the item, receiver (20) when said item receiver (20) is not in use.

Obviously, the shape of the containing means (21) could vary considerably and still function satisfactorily, but in the preferred embodiment of this invention, the containing means (21) is a generally rigid boxlike structure constructed of generally flat platelike material having substantial open space in the interior and having a top side (22), right side (23), left side (24), bottom side (26), bottom side inner surface (36), open front end (27), back side (25) (which is oppositely disposed to said open front end), a barrier means (38), and two holes on the top side (22) near the open front end (27), said holes being the right pulling means hole (35) and the left pulling means hole (34). All five said sides and the open front end are generally rectangular in shape wherein the top side (22) and the bottom side (26) are generally parallel, and the left side (24) and the right side (23) are also generally parallel, and the back side (25) is generally perpendicular to the other four sides. The open front end (27) is open space and is bounded by the front top side edge (28), front bottom side edge (29), front right side edge (30) and front left side edge (31). Note in FIG. 13 that the front bottom side edge (29) is rounded rather than sharp in order to prevent said front edge (29) from snagging on grass and also to allow the item receiver (20) to cam over small obstructions as the item receiver (20) is being pulled along.

Figure 12:
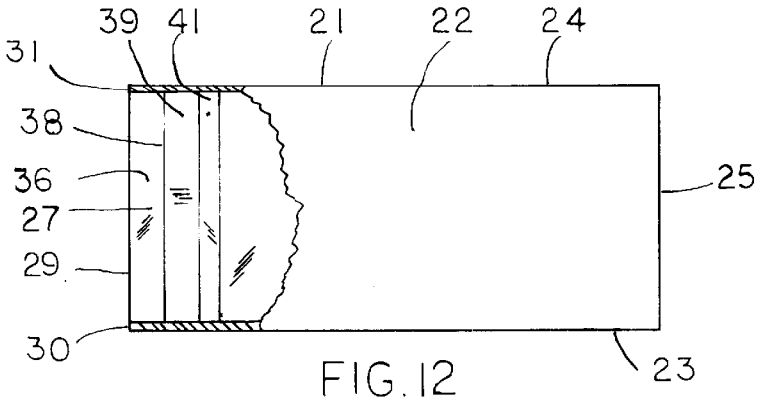
FIG. 12 is a cutaway top view of the containing means showing the barrier means.
Figure 13:
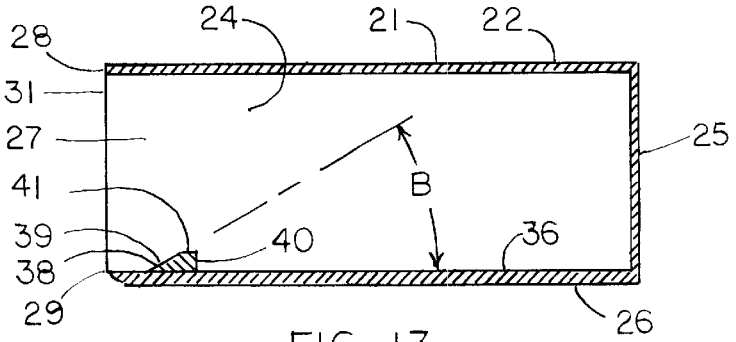
FIG. 13 is a right side cutaway view of the containing means showing the total interior including the barrier means.

In the preferred embodiment of this invention, the barrier means (38) is essentially a dam and, as shown in FIGS. 1, 12 and 13, is located on and attached to the containing means bottom side inner surface (36) near the front bottom side edge (29) and extends from the right side (23) to the left side (24) in a fashion that is generally perpendicular to the right side (23) and left side (24). The barrier means front side is an inclined plane (39), said inclined plane (39) being the deflection means, which is at such an angle, relative to the bottom side inner surface (36), that when struck by an incoming item, most said items would be deflected upwards and over the barrier means (38) and continue on into the containing means (21). The inclined plane (39) begins at the bottom side inner surface (36) and extends upwards and backwards and terminates in a barrier means top surface (41), said top surface (41) being generally parallel to the bottom side inner surface (36). The purpose of the said top surface (41) is to prevent the sharp edge that would result if the inclined plane (39) was intersected by the barrier means back (40). The precise angle of the inclined plane (39) relative to the bottom side inner surface (36), shown as angle B in FIG. 13, can vary over a considerable angle range and still render a barrier means (38) that functions satisfactorily, but in the preferred embodiment, the inclined plane angle is about 35 degrees. The barrier means back (40) begins at the bottom side inner surface (36) and extends upwards in a fashion generally perpendicular to the inner surface (36) and terminates in the barrier means top surface (41). The height of the barrier means (38) is such that ample open space exists above the barrier means (38) for item entry. The barrier means (38) is configured to occupy a limited amount of area near the front bottom side edge (29) so as to leave substantial room behind the barrier means (38) for collected items to reside.

In FIG. 14, note the left pulling means hole (34) and the right pulling means hole (35) located on the top side (22) near the front top side edge (28). These two holes are used to attach the pulling means (32) to the containing means (21). These two holes are seperated by a space and said holes are equidistant from the front top side edge (28). The center point of said space between the holes is equidistant from the right side (23) and the left side (24) of the containing mean (21).

A pulling means (32) is attached to the containing means near the open front end (27) wherein the pulling mean's (32) function is to be grasped by the user and allow the user to pull the containing means (21) in any direction on a horizontal surface and also to pull the containing means (21) in an upwards direction. Any number of devices could serve as a pulling means (32), such as a chain, or even a tongue attached to the containing means (21) by some type of universal joint. In the preferred embodiment of this invention, however, the pulling means (32) is a cord that is attached to the containing means (21) by looping said cord through the left pulling means hole (34) and the right pulling means hole (35) wherein several knots are tied in the cord, said knots acting as hand grip means (33) and also acting to secure the pulling means (32) to the containing means (21). The cord length and the number and the spacing of the knots can vary considerably and still result in a pulling means (32) that functions satisfactorily. However, the cord should be long enough that a pulled item receiver (20) will not contact the heels of any size potential user.

The precise size of a containing means (21) is rather arbitrary and can vary considerably and still result in a containing means (21) that functions satisfactorily. For instance, a containing means (21) that was designed to be used to collect and store toys could be significantly larger than one designed to collect lawn debris because many toys are much larger than the average lawn debris item.

What is claimed is:

1. An item collection device comprising:

(a) an item mover, said item mover comprised of a handle, striking means, lifting means and an adjustable attaching means, said handle being elongated and generally cylindrical and having a top end, bottom end and a longitudinal axis wherein the lower portion of said handle is configured to be an integral component of the adjustable attaching means and to interface with and receive the remaining components of the adjustable attaching means, said striking means having a generally flat front surface and a straight bottom edge, said striking means configured to be an integral component of said adjustable attaching means and to interface with and receive the remaining components of the adjustable attaching means, wherein the striking means is attached to the handle in the lower portion of said handle by the adjustable attaching means, said lifting means being generally flat and platelike having a generally sharp front edge, a straight back edge, a top surface and an oppositely disposed bottom surface, wherein said lifting means back edge is joined at a junction to the striking means bottom edge, wherein said junction may be at a sharp intersection of the lifting means and the striking means or the junction may be rounded wherein the junction would include all the material required in the round portion to join the striking means bottom edge to the lifting means back edge, said lifting means extending laterally outwardly from the striking means front surface and terminating in the lifting means front edge, wherein the striking means is attached to the handle in an orientation such that the plane established by the striking means front surface is either generally parallel to, or includes, the handle longitudinal axis, said adjustable attaching means providing a means to attach the handle to the striking means in either one of two positions, either said position providing a handle offset wherein, in a view facing the lifting means front edge, in one position the handle top end is upwards and to the right of the striking means rendering the item mover convenient to be used by the right hand, wherein in the other position, the handle top end is upwards and to the left of the striking means rendering the item mover convenient to be used by the left hand, wherein a handle offset angle exists between the handle longitudinal axis and a plane X, said plane X being established by the bottom surface of the lifting means, said handle offset angle being measured in a plane Y, wherein plane Y contains the handle longitudinal axis and also perpendicularly intersects said plane X, whereas a handle offset angle can be any angle within a considerable angle range and still render an item mover that functions satisfactorily;

(b) an item receiver, said item receiver being comprised of a containing means and a pulling means, said containing means comprised of a generally rigid structure having an open front end, bottom side, bottom side inner surface, back side and a barrier means, said containing means being enclosed except for the front end portion, said containing means having substantial interior vacant space, said containing means being configured to allow attachment of the pulling means near the open front end, said back side being oppositely disposed from the open front end, said bottom side inner surface resides inside the containing means, said bottom side inner surface being the top surface of the bottom side, said open front end is open space that exposes the interior of the containing means including the bottom side inner surface, said containing means orientation during the item collection process is such that the bottom side rests on the item bearing surface, said barrier means being attached to the bottom side inner surface near the open front end, said barrier means so configured that substantial open space exists above said barrier means to allow item entry into the containing means, said barrier means also configured to occupy a limited amount of space in an area near the open front end so as to leave substantial room to the rear of the barrier means where collected items may reside, wherein the barrier means functions to prevent, up to a limited amount, already collected items from spilling out of the containing means during the item collection process, wherein the amount of the limited amount of said items is generally proportional to the height of the barrier means, said barrier means containing a deflection means, said deflection means functioning to deflect most entering items that happen to strike said barrier means in a manner that the items travel upwards and over the barrier means, allowing said items to continue on into the containing means, wherein the containing means back side is so configured that said back side could rest on a flat horizontal surface thereby placing the containing means in an upright position wherein the open front end would be above the back side, wherein the upright position is useful for storage purposes, said pulling means is attached to the containing means near the open front end, wherein the pulling means provides a means for pulling the containing means in any direction on a horizontal surface and also in an upwards direction away from the horizontal surface.

2. The item collection device of claim 1 wherein the striking means is generally flat, platelike and rectangular in shape, having a front surface, rear surface, top edge, right edge, left edge and a straight bottom edge, wherein the lifting means is generally flat, platelike and generally rectangular in shape, having a top surface, bottom surface, right edge, left edge, front edge and a straight back edge, wherein the front edge is straight and generally sharp, wherein the lifting means back edge is joined to the striking means bottom edge at a junction wherein the lifting means extends outwardly from the striking means front surface in a fashion generally perpendicular to the striking means front surface wherein the angle between the striking means front surface and the lifting means bottom surface is about 90 degrees, wherein the lengths of the striking means bottom edge and the lifting means back edge are equal, wherein the entire length of the lifting means back edge is joined to the entire length of the striking means bottom edge, wherein the striking means front surface establishes a plane that is generally parallel to, or includes, the handle longitudinal axis, wherein the adjustable attaching means is comprised of two holes in the lower portion of the handle, three holes in the striking means and two bolts and two nuts, wherein the two holes in the handle are identified as the top handle hole and the bottom handle hole, said handle holes being parallel, wherein the center line of each said handle hole perpendicularly intersects the handle longitudinal axis, wherein the top handle hole is nearer to the handle top end than the bottom handle hole, wherein the bottom handle hole is nearer the lifting means than the top handle hole, said three holes in the striking means being identified as the bottom striking means hole, the top right striking means hole and the top left striking means hole, wherein in a view facing the lifting means front edge with the lifting means in a horizontal position and the striking means above the lifting means then the bottom striking means hole is in the lower center portion of the striking means and the top right striking means hole is above and to the right of the bottom striking means hole and the top left striking means hole is above and to the left of the bottom striking means hole, wherein all five said holes are so positioned that all hole alignments mentioned hereafter are possible, wherein the position of the top right striking means hole relative to the position of the bottom striking means hole determines the precise handle offset angle of one of the two possible handle positions on the striking means, wherein the position of the top left striking means hole relative to the position of the bottom striking means hole determines the precise handle offset angle of the other of the two possible handle position on the striking means, whereas when the bottom striking means hole is aligned with the bottom handle hole and the top right striking means hole is aligned with the top handle hole and a bolt is inserted into each of the two sets of aligned holes and a nut secures each said bolt, then the handle is attached to the striking means in one of the two possible positions, whereas when the bottom striking means hole is aligned with the bottom handle hole and the top left striking means hole is aligned with the top handle hole and a bolt is inserted into each of these two sets of aligned holes and a nut secures each said bolt, then the handle is attached to the striking means in the other of the two possible positions, wherein whether the handle is attached in either of the two handle positions, the handle bottom end is located sufficiently above the lifting means to not strike the item bearing surface when the item mover is being used to move items into the item receiver.

3. The item collection device of claim 2 wherein the top right striking means hole is so positioned relative to the bottom striking means hole that a handle offset angle of about 58 degrees is obtained, wherein the top left striking means hole is so positioned relative to the bottom striking means hole that a handle offset angle of about 58 degrees is obtained.

4. The item collection device of claim 1 wherein the containing means is a generally rigid boxlike structure constructed of generally flat platelike material having a top side, bottom side, right side, left side, back side and an open front end, wherein all five said sides and the open front end are generally rectangular in shape, wherein the top side and the bottom side are generally parallel, wherein the right side and the left side are generally parallel, wherein the back side is generally perpendicular to the other four sides, wherein the top surface of the bottom side is the bottom side inner surface, said open front end being bounded by the front top side edge, front right side edge, front left side edge and the front bottom side edge, wherein the front bottom side edge is rounded, wherein two holes that are separated by a space exist in the top side near the front top side edge, said holes being equidistant from the front top side edge and the center point of said space is located equidistant from the right side and the left side, wherein in a view facing the open front end, the hole nearest to the right side is identified as the right pulling means hole and the other hole is identified as the left pulling means hole, said two holes functioning in the attachment of the pulling means to the containing means, wherein the pulling means is a cord that is attached to the containing means by looping said cord through the two holes, wherein several knots are tied along the length of the cord, said knots sufficiently spaced apart to act as convenient hand grip means, said knots also acting to secure the attachment of the cord to the containing means, wherein the barrier means is a dam located on and attached to the bottom side inner surface near the front bottom side edge, said barrier means extending in a generally straight line from the right side to the left side of the containing means, said barrier means being generally perpendicular to both the right side and the left side, said barrier means being comprised of an inclined plane, a barrier means back and a barrier means top surface, wherein the inclined plane is the deflection means, said barrier means top surface being generally parallel to the containing means bottom side inner surface, said inclined plane being the barrier means component nearest the front bottom side edge, said inclined plane beginning at the bottom side inner surface and extending upwards and backward and terminating at the barrier means top surface, said barrier means back beginning at the bottom side inner surface and extending upwards in a fashion generally perpendicular to said bottom side inner surface and terminating in the barrier means top surface, whereas the angle of the inclined plane relative to the bottom side inner surface can be any angle within a considerable angle range and still render a barrier means that functions satisfactorily.

5. The item collection device of claim 4 wherein the angle of the inclined plane relative to the bottom side inner surface is about 35 degrees.

* * * * *